United States Patent [19]

Merrick

[11] Patent Number: 4,607,881

[45] Date of Patent: Aug. 26, 1986

[54] SEAT CADDY FOR SPECTATOR SEATING

[76] Inventor: Bruce C. Merrick, 3505 Locust Ct., Prospect, Ky. 40059

[21] Appl. No.: 680,159

[22] Filed: Dec. 10, 1984

[51] Int. Cl.[4] ..... A47C 9/14

[52] U.S. Cl. ..... 297/192; 108/114; 211/113

[58] Field of Search ..... 297/192, 188, 193; 211/11, 86, 88, 113, 126, 31; 108/149

[56] References Cited

U.S. PATENT DOCUMENTS

| | | | |
|---|---|---|---|
| 927,235 | 7/1909 | Hamm | 108/114 |
| 1,147,505 | 7/1915 | Henigson | 211/113 X |
| 2,023,173 | 12/1935 | Heiner | 297/192 |
| 2,748,841 | 6/1956 | Rimkus | 297/192 |
| 3,099,482 | 7/1963 | Woodruff, Sr. | 297/192 |
| 3,180,680 | 4/1965 | Landvik | 297/192 |
| 3,584,915 | 6/1971 | Meyers, Jr. | 297/192 |
| 4,252,372 | 2/1981 | Harder, Jr. | 297/452 |
| 4,372,605 | 2/1983 | Cervantes | 297/192 |
| 4,429,796 | 2/1984 | Sussman | 211/11 |
| 4,494,658 | 1/1985 | Simon et al. | 211/126 X |

FOREIGN PATENT DOCUMENTS

| | | | |
|---|---|---|---|
| 727422 | 2/1966 | Canada | 297/192 |

*Primary Examiner*—Peter A. Aschenbrenner

*Attorney, Agent, or Firm*—Woodard, Weikart, Emhardt & Naughton

[57] ABSTRACT

A seat caddy for stadium type bleacher seating, comprises a rack having depending and article supporting bottom portions of lattice construction. The depending portion extends downwardly from the seat, the upper end being connected to the seat by suitable fastening means. The bottom portion extends forwardly from and is integrally formed with the lower end of the depending portion. The caddy further includes one or more hangars each having upper and lower ends. The hangars are attached at their respective lower ends to the front of the bottom portion and attached at their respective upper ends to the front portion of the seat. The rack integrally includes means at each end thereof for interlocking to other similarly formed racks in order to form a rack of increased length which extends along substantially the full length of the seat. The hangars, seat and bottom portion defining an access opening therebetween for storage of articles in the rack.

5 Claims, 4 Drawing Figures

SEAT CADDY FOR SPECTATOR SEATING

BACKGROUND OF THE INVENTION

The subject invention relates generally to seats and, more particularly, to a seat caddy for spectator seating which is useful for placing valuable articles such as clothing, umbrellas, binoculars, etc.

A common problem encountered when attending spectator events involves finding a convenient place for storing extra items such as hats, coats, umbrellas, binoculars, programs, etc. Because the space allocated to each spectator for seating is typically very limited, it is often necessary to place such articles on the deck or footboards below one's seat. Such placement is less than ideal for several reasons. For example, valuable articles placed in such a location can easily become damaged or destroyed by other spectators attempting to move to or away from their seats. Further, concession foods and drinks are often placed and discarded in the same location, which makes this location unsanitary and raises a risk of damage from spills. Moreover, even despite the risk of damage to such articles, placement on the deck or footboards is inconvenient in that it restricts the available foot space in the area of the seat.

Other various types of devices for use with seats are disclosed in the following patents:

| U.S. Pat. No. | Inventor | Issued |
|---|---|---|
| 4,252,372 | Harder, Jr. | Feb. 24, 1981 |
| 4,372,605 | Cervantes | Feb. 8, 1983 |
| 3,099,482 | Woodruff, Sr. | July 30, 1963 |
| 2,023,173 | Heiner | Dec. 3, 1935 |

U.S. Pat. No. 4,372,605 to Cervantes discloses a tray attached to the underside of a chair used by a hair dresser. The tray, which is movable between an extended usable position to a retracted stowed position, is intended for storing various hairdressing articles for use.

U.S. Pat. No. 3,099,482 to Woodruff, Sr. discloses a seat adapted for use on boats or docks which includes an ice storage container forming the underside of and support for the seat.

U.S. Pat. No. 2,023,173 to Heiner discloses a receptacle, attachable to the rear legs of a seat, for storing concession articles, such as beverage bottles.

Additionally, U.S. Pat. No. 4,252,372 to Harder, Jr. discloses a device which is attachable to the underside front portion of a bus seat and forms a trash shield which prevents the depositing of trash in the gap between the seat and the horizontal seat support bar beneath the seat.

None of the devices disclosed in the above described patents provides a storage container, particularly suited for stadium type bleacher seating, which is conveniently located and useful for storing valuable items such as clothing, umbrellas, binoculars, etc., or other items not intended for consumption.

SUMMARY OF THE INVENTION

A seat caddy for stadium type bleacher seats, according to one embodiment of the present invention comprises a rack having a depending portion having upper and lower ends and extending downwardly from the seat. The upper end is connected to the seat by suitable fastening means. The rack further includes an article supporting bottom portion, positioned directly below the seat, which extends forwardly from and is integrally formed with the lower end of the depending portion. One or more hangars are also provided which support the front bottom portion of the rack. Each hangar has an upper and lower end, the one or more hangars being attached at their respective lower ends to the front of the bottom portion and attached at their respective upper ends to the front portion of the seat. The one or more hangars, seat and bottom portion together define a front access opening therebetween for storing articles within the rack.

Accordingly, it is an object of the present invention to provide an improved seat caddy for stadium type bleacher seating.

Related objects and advantages of the present invention will become more apparent by reference to the following figures and detailed description.

DESCRIPTION OF THE PREFERRED EMBODIMENT

Figure 1:
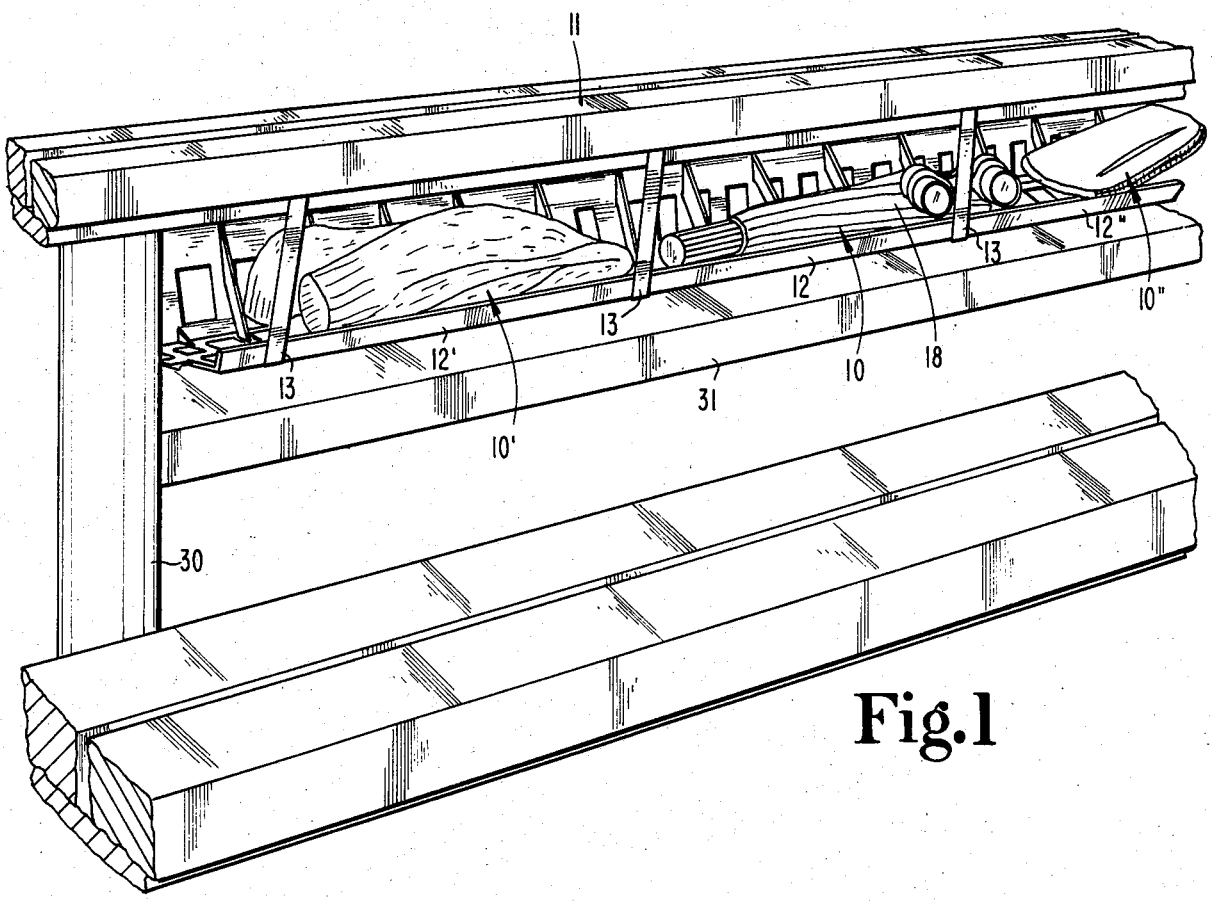
FIG. 1 is a perspective view showing the seat caddy of the present invention in its mounted position underneath a bleacher seat and connected to other similarly formed seat caddies to form a seat caddy assembly of increased length.
Figure 2:
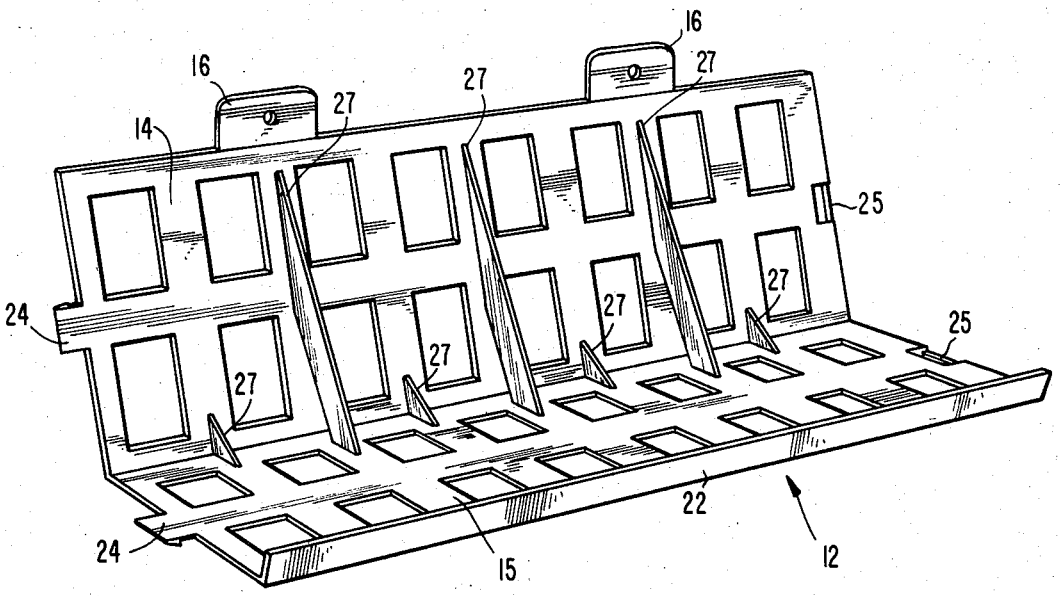
FIG. 2 is a perspective view showing the rack.
Figure 3:
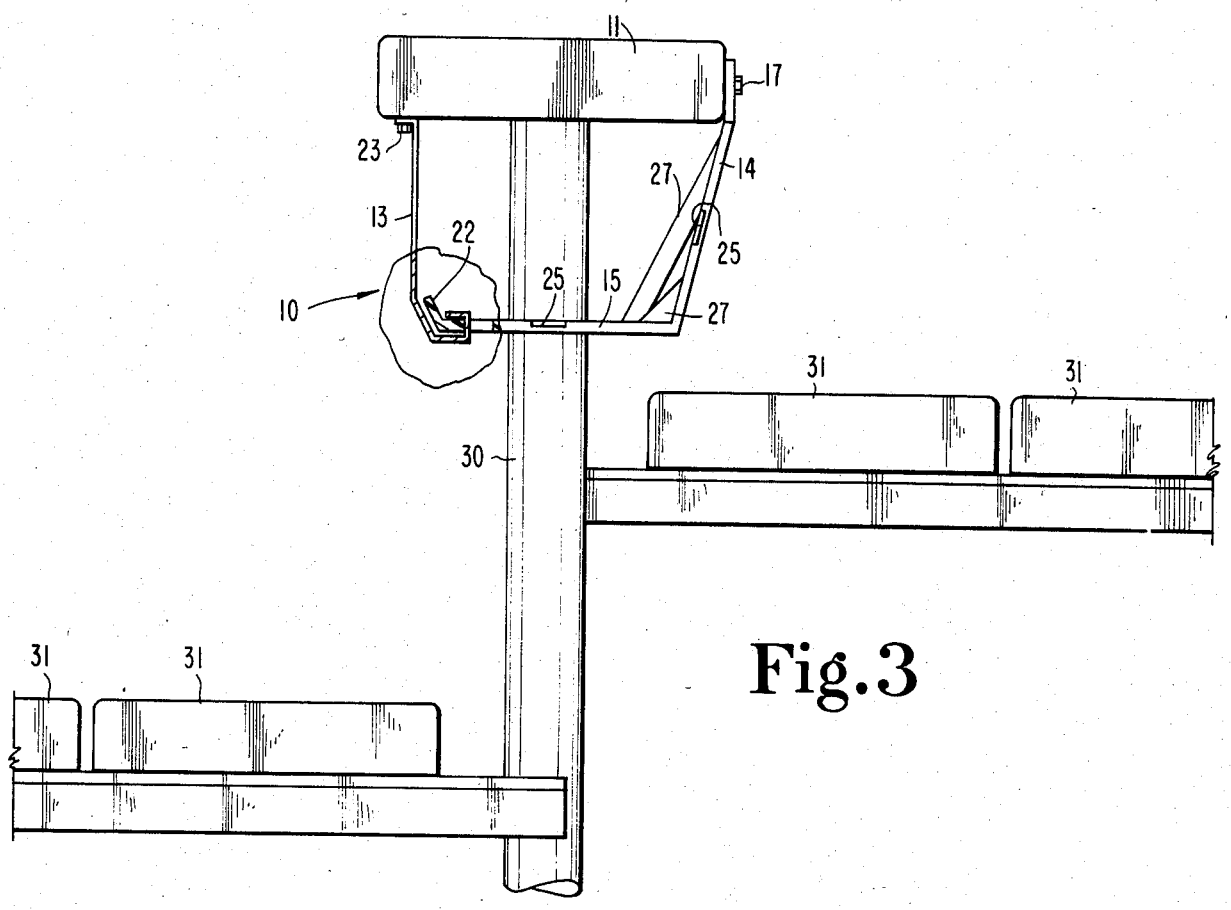
FIG. 3 is an end elevation view, partially in section, showing the seat caddy of the present invention in its mounted position underneath a bleacher seat.
Figure 4:
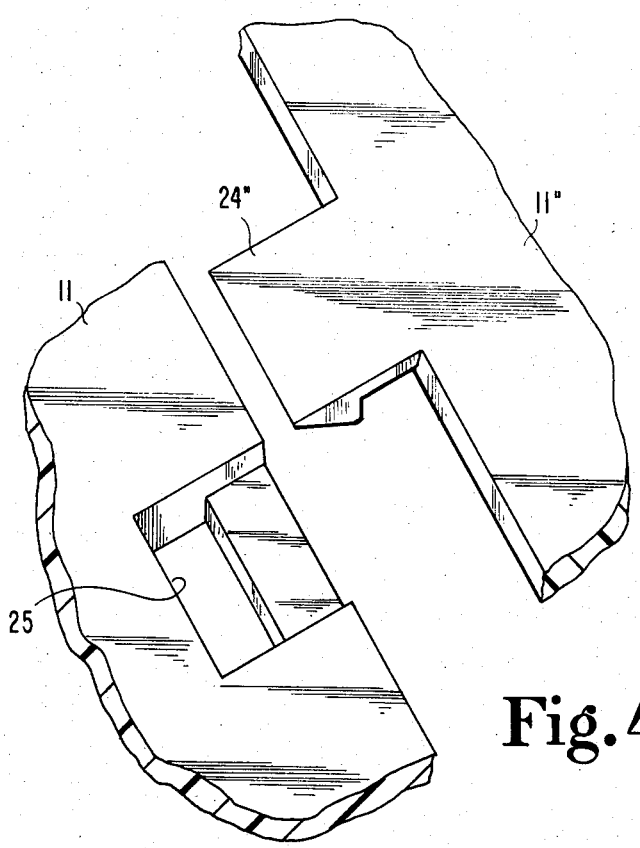
FIG. 4 is a fragmentary perspective view showing the means for interlocking racks together.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, the seat caddy of the present invention is generally designated at 10. In FIG. 1, the seat caddy 10 is shown mounted directly below a bleacher seat 11 of conventional construction and attached at each end to similarly formed seat caddies 10' and 10'', respectively. Seat caddy 10 generally includes a rack 12 extending horizontally along the underside of seat 11 and one or more hangers 13 supporting the front portion of rack 12 at horizontally spaced intervals.

Rack 12, which is preferably characterized by a one piece rigid plastic construction, includes a back portion 14 extending downwardly from seat 11 and an article supporting bottom portion 15 which extends forwardly from back portion 14 at the lower end thereof. A plurality of vertically disposed strengthening ribs 27 are integrally formed with and extend between the back portion 14 and bottom portion 15 of rack 12 at horizontally spaced intervals. In the preferred embodiment, the back and bottom portions 14 and 15, respectively, have a lattice or webbed construction although, alternatively, other constructions could also be employed.

Rack 12 integrally includes complimentarily formed mating tabs 24 and slots 25 located on opposite ends of back portion 14 and bottom portion 15. Tabs 24 and slots 25 are adapted to interlock in a mating snap fit with corresponding tabs and slots on other similarly formed racks 12' and 12''. Thus, a number of racks may be interlocked side to side in order to form a continuous rack assembly along substantially the full length of the seat 11, excepting only that portion of the seat 11 needed for location of seat support members 30.

The upper end of back portion 14 is provided with a pair of spaced apart tabs 16 having mounting holes through which a suitable fastening means 17, such as a rivet or screw, is used to mount rack 12 to the rear of seat 11.

An upturned flange 22 extends forwardly and upwardly from the front of bottom portion 14 and is integrally formed therewith. Flange 22 extends along the full length of rack 11 and serves to facilitate the retention of articles placed in caddy 10 while also permitting easy removal therefrom.

Hangars 13 serve to support the front portion of rack 12 beneath seat 11. Hangers 13 are spaced apart as desired and fixedly attached at their respective upper ends to the front underside portion of seat 11 by a suitable fastening means 23 which may, for example, be a rivet or screw. At their lower ends, the hangars 13 attach in a wrap around snap fit to the front of bottom portion 15. The hangars 13, seat 11 and bottom portion 15 together define therebetween an access opening 18 through which various articles may be conveniently placed and removed by a spectator seated on seat 11.

It may be appreciated that articles stored in seat caddy 10 are spaced above the footboards 31 directly in front of and behind caddy 10 and therefore does not restrict, or minimally restricts, the available foot space in the area of seat 11. In addition to permitting maximum foot space for one's feet, storage of personal items, such as jackets, umbrellas, binoculars, etc., in seat caddy 10 prevents damage to such articles caused by spillage of food or drink from containers placed on the footboards 31, or from other spectators accidently stepping on same. Also, it may be appreciated that the webbed construction of back portion 14 makes it difficult for persons in the row immediately behind the caddy from gaining unauthorized access to articles in the caddy.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A seat for spectator seating, comprising:

a bleacher seat plank;

a rack sized and adapted to extend along the underside of said bleacher seat plank, said rack including an article supporting bottom and a back portion integrally formed with said bottom and including fastening means for depending said back portion from the rear underside of said bleacher seat plank, said bottom aligned vertically below said bleacher seat plank and said back portion having a sufficiently closed construction to prevent passage of articles therethrough; and a plurality of support members horizontally spaced apart and extending vertically between the bottom of said rack and said bleacher seat plank, said bleacher seat plank, bottom of said rack and adjacent ones of said support members together defining an access opening therebetween for placing and removing articles to and from said rack, wherein said rack integrally includes means for interlocking said rack to another similarly formed rack fastened to said plank in order to form a continuous rack along substantially the full length of said bleacher seat plank.

2. The seat of claim 1 wherein said bottom and said back portion have a lattice framework.

3. The seat of claim 1 wherein said interlocking means includes complimentarily formed mating tabs and slots on opposite sides of said back portion and bottom adapted to interlock in a snap fit with corresponding tabs and slots on other similarly formed racks.

4. The seat of claim 1 wherein said rack further includes a plurality of vertically disposed strengthening ribs interconnecting said back portion and bottom.

5. A bleacher seating system used for spectator seating, comprising:

a bleacher seat plank;

a plurality of racks connected side to side and extending along and directly beneath said bleacher seat plank, said racks each having (a) a back portion including fastening means for depending said back portion from the rear underside of said bleacher seat plank, (b) an article supporting bottom portion extending forwardly from and integrally formed with said back portion, and (c) an interlocking means including complimentarily formed mating tabs and slots on opposite sides of said bottom and back portion adapted to interlock with corresponding tabs and slots on other similarly formed racks fastened to said plank in order to form a continuous rack along substantially the full length of said bleacher seat plank; and a plurality of horizontally spaced apart support members each having upper and lower ends, said support members attached at their respective lower ends to the bottom of said racks and adapted to attach at their respective upper ends to the front portion of said bleacher seat plank, said support members, seat plank and bottom of said racks defining access openings therebetween for storage of articles in said racks.

* * * * *